US005704666A

United States Patent [19]

Guillemette

[11] Patent Number: 5,704,666

[45] Date of Patent: Jan. 6, 1998

[54] SECURITY DEVICE FOR A DEAD BOLT LOCK

[76] Inventor: Christian Guillemette, 257 St-Michel, Beauport, Québec, Canada, G1C 1G4

[21] Appl. No.: 744,634

[22] Filed: Nov. 6, 1996

[51] Int. Cl.[6] ..... E05B 17/00

[52] U.S. Cl. ..... 292/346; 292/340; 70/418

[58] Field of Search ..... 292/195, 346, 292/340; 70/416, 417, 418

[56] References Cited

U.S. PATENT DOCUMENTS

| | | | |
|---|---|---|---|
| 1,193,653 | 8/1916 | Winn et al. | 292/341.14 |
| 1,804,277 | 5/1931 | Ruiz | 292/346 |
| 2,353,844 | 7/1944 | Keeper | 292/340 |
| 2,370,781 | 3/1945 | Cullum | 292/346 |
| 2,786,705 | 3/1957 | Stalmer | 292/297 |
| 3,039,807 | 6/1962 | Agnese | 292/346 |
| 3,318,625 | 5/1967 | Bogosian | 292/346 |
| 3,411,817 | 11/1968 | Carver | 292/298 |
| 3,422,543 | 5/1969 | Weyman | 292/340 |
| 3,633,955 | 1/1972 | Read | 292/292 |
| 4,181,338 | 1/1980 | Sterling | 292/341.17 |
| 4,311,330 | 1/1982 | Lum | 292/210 |
| 4,379,577 | 4/1983 | Robertson | 292/341.15 |
| 4,765,662 | 8/1988 | Suska | 292/92 |
| 4,865,370 | 9/1989 | Francis | 292/340 |

FOREIGN PATENT DOCUMENTS

| | | | |
|---|---|---|---|
| 1120969 | 3/1982 | Canada . | |
| 1228094 | 10/1987 | Canada . | |
| 396660 | 8/1933 | United Kingdom | 292/346 |

*Primary Examiner*—Rodney M. Lindsey
*Attorney, Agent, or Firm*—Robic

[57] ABSTRACT

The security device is suitable for use with any conventional dead bolt lock mounted on a door. It comprises a plate shaped to extend flat on the outer lateral surface of the doorframe. A security lever is mounted on the security device and is pivotable about a vertical axis adjacent to the plate. The security lever includes an inner arm extending on one side of the plate in the cavity of the doorframe in a position such that the dead bolt, in a lock position, abuts on the inner arm and causes the lever to pivot around its axis. The lever further includes an outer arm extending on another side of the plate shaped and sized to extend on the door behind the dead bolt, when the dead bolt has been brought to a lock position and has caused the lever to pivot around its axis. With a security device according to the present invention, the locking of the dead bolt lock is performed in only one step by simply engaging the door lock, thereby engaging the security device simultaneously.

13 Claims, 3 Drawing Sheets

SECURITY DEVICE FOR A DEAD BOLT LOCK

FIELD OF THE INVENTION

The present invention relates to the field of security devices for door locks, more particularly to a security device for dead bolt locks.

BACKGROUND OF THE INVENTION

Known in the art, there are different types of security devices for door locks. In general, they can be divided in two main groups, a first one having as an object to prevent or deter forced entry through a locked door and a second one affording emergency door operation. This latter type is generally used in hospital centers or in retirement homes.

A drawback with the above-mentioned first type of devices known in the art is that in general, they are mainly adapted to latch bolt locks and not to dead bolt locks. If they are adapted to dead bolt locks, their mechanism is usually independent from the mechanism of the lock itself. Thus, for securely locking a door with those types of security devices, the door lock must be first engaged and then, in a second step, the security device has to be engaged.

For the foregoing reasons, there is presently a need for a security device for a door lock which, on one hand would be mostly adapted for a dead bolt lock and, on the other hand, would work intimately with the door lock mechanism so that the locking of the door would only take one step to perform.

SUMMARY OF THE INVENTION

An object of the present invention is to propose a security device for a door lock which satisfies the above-mentioned needs. More particularly, the present invention proposes a security device for a dead bolt lock, the lock being mounted on a door having a given outline, the door itself being mounted in a doorframe provided with a door stop on which the door abuts when it is closed, an inner surface surrounding the door when the door is closed, and an outer lateral surface disposed opposite the door stop with respect to the inner surface, the dead bolt being movable between an unlock position where it remains inside the outline of the door thereby allowing the door to open, and a lock position where the dead bolt juts out over the outline of the door and engages a cavity provided for that purpose in the inner surface of the doorframe, the security device comprising:

a first rigid vertical plate shaped to extend flat on the outer lateral surface of the doorframe opposite the door stop just in front of the cavity in the doorframe;

a security lever mounted on the security device and pivotable about a vertical axis adjacent to the first plate, the security lever including an inner arm extending on one side of the first plate in the cavity of the doorframe in a position such that the dead bolt, in the lock position, abuts on the inner arm and causes the lever to pivot around its axis, the lever further including an outer am extending on another side of the first plate opposite said one side, shaped and sized to extend on the door behind the dead bolt, when the dead bolt has been brought to the lock position and has caused the lever to pivot around its axis; and first fastening means for securing the security device via the first plate to the doorframe.

Preferably, the security device further comprises a second rigid vertical plate integral to the first plate and shaped to extend flat on the inner surface of the doorframe, the second plate being provided with an opening set to face the cavity in the doorframe and for receiving the dead bolt; and second fastening means for securing the security device to the doorframe via the second plate.

Also preferably, the security device further comprises a rigid sleeve integral to the first and second plates, the sleeve being coaxial with the opening provided in the second plate and extending in the cavity of the doorframe for receiving the dead bolt as it is in a lock position.

As can be appreciated, with a security device according to the present invention, the locking of the dead bolt lock is performed in only one step by simply engaging the door lock thereby engaging the security device simultaneously. Moreover, the outer arm of the lever, which abuts the door behind the bolt in the lock position, thus reinforcing the lock, acts as an armour. Such a security device greatly lowers the chances that someone knock down the door. Another advantage of a security device according to the present invention is that it is of simple construction, low in cost and very easy to install on a doorframe.

A non restrictive description of preferred embodiments of the invention will now be given with reference to the appended drawings.

DESCRIPTION OF PREFERRED EMBODIMENTS OF THE INVENTION

Figure 1:
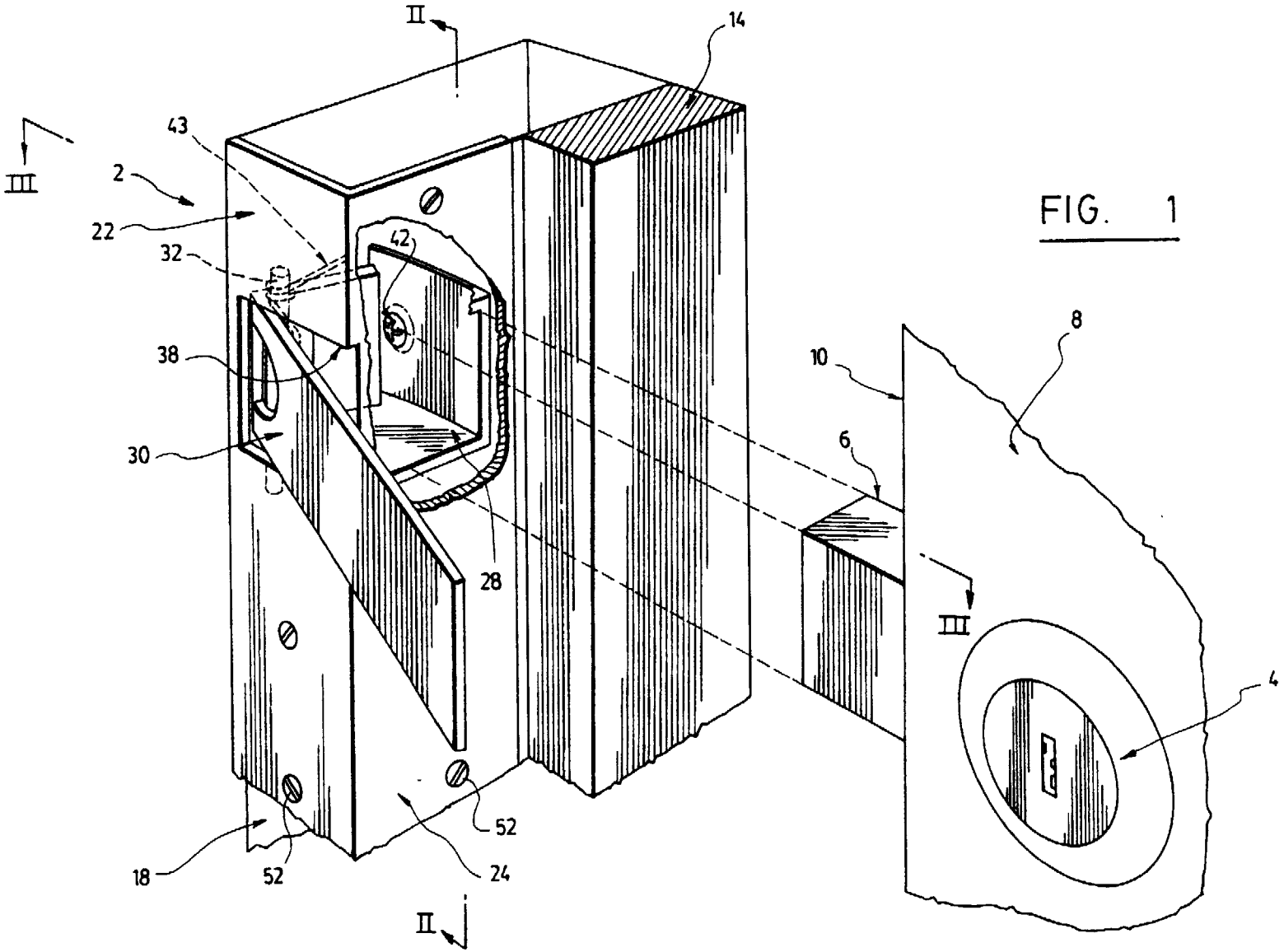
FIG. 1 is a perspective view of a preferred embodiment of a security device according to the present invention.

Referring to FIG. 1, the security device (2) is used mainly for reinforcing a conventional dead bolt lock (4). The lock (4) is mounted on a door (8) having a given outline (10). The door (8) itself is mounted in a doorframe (12) provided with a door stop (14) on which the door (8) abuts when it is closed. The doorframe (12) further comprises an inner surface (16) surrounding the door (8) when it is closed, and an outer lateral surface (18) disposed opposite the door stop (14) with respect to the inner surface (16). As usual, the dead bolt (6) is movable between an unlock position where it remains inside the outline (10) of the door (8) thereby allowing the door to open, and a lock position where the dead bolt (6) juts out over the outline (10) of the door (8) and engages a cavity (20) provided for that purpose in the inner surface (16) of the doorframe (12).

Figure 3:
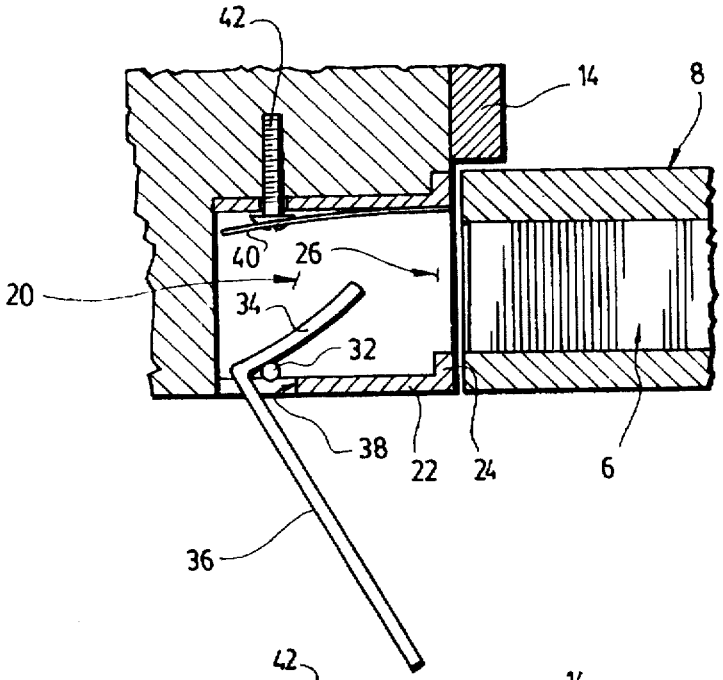
FIG. 3 is a cross-sectional top view of FIG. 1 along line III—III, showing a preferred version of a lever and in which the dead bolt is in an unlock position.

The security device comprises a first rigid vertical plate (22) shaped to extend flat on the outer lateral surface (18) of the doorframe opposite the door stop (14) just in front of the cavity (20) in the doorframe (12). Preferably, the security device (2) further comprises a second rigid vertical plate (24) integral to the first plate (22). This second plate (24) is shaped to extend flat on the inner surface (16) of the doorframe (12), and is provided with an opening (26), as shown in FIG. 3, set to face the cavity (20) in the doorframe (12) and for receiving the dead bolt (6). It has to be noted that another preferred embodiment of the present invention may very well not comprise only the second above-mentioned plate without departing from the scope of the present invention.

Figure 2:
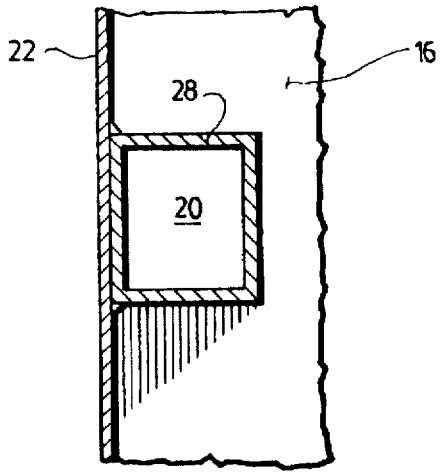
FIG. 2 is a cross-sectional view of FIG. 1 along line II—II, showing the dead bolt receiving sleeve.

Also, preferably, for increasing its effectiveness and as illustrated in FIG. 2, the security device (2) further comprises a rigid sleeve (28) integral to the first and second plates (22,24). This sleeve (28) is coaxial with the opening (26) provided in the second plate (24) and extends in the cavity (20) of the doorframe (12) for receiving the dead bolt (6) as it is in a lock position.

Figure 4:
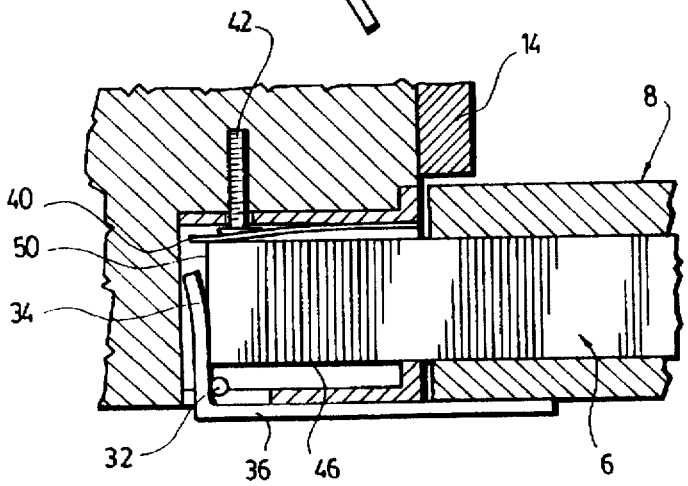
FIG. 4 is the same view as FIG. 3 showing the dead bolt in a lock position.

Referring to FIGS. 3 and 4, a security lever (30) is mounted on the first plate (22) of security device (2) and is pivotable about a vertical axis (32) adjacent to the first plate (22). The security lever (30) includes an inner arm (34) extending on one side of the first plate (22) in the cavity (20) of the doorframe (12) or in the sleeve (28) when the device (2) is provided with such a sleeve (28) as illustrated in FIG. 1. The inner arm (34) extends in a position such that the dead bolt (6), in the lock position, abuts on the inner arm (34) and causes the lever (30) to pivot around its axis (32). The lever (30) further includes an outer arm (36) extending on another side of the first plate opposite said one side, shaped and sized to extend on the door (8) behind the dead bolt (6), when the dead bolt has been brought to the lock position and has caused the lever (30) to pivot around its axis (32).

As illustrated in FIGS. 1, 3 and 4, the outer arm (36) of the lever (30) is preferably flat and has an elongated shape.

Preferably, the first plate (22) is provided with an opening (38) on the inside of the sleeve (28), the vertical axis (32) or hinge of the lever (30) extending across this opening.

The device (2) further comprises first and second fastening means for securing the security device via the first and second plates (22,24). Those fastening means may be screws or any other fastener known in the art such as nails, bolts, etc.

As can be appreciated, the outer arm (36), as it abuts on the door (8), is greatly reinforcing the door lock (4) as acting as an "armour". A device according to the present invention greatly lowers the chances for anyone to knock down the door.

In each of the preferred embodiments, the height of the first and second plates (22,24) is greater than the height of the opening (26) in the second plate (24). Advantageously, those plates (22,24) have a height at least three times greater than the height of the opening (26) in the second plate (24).

The first plate (22), the second plate (24), the sleeve (28) and the lever (30) are preferably made of metal and the sleeve (28) may be welded to the first and second plates (22,24).

Referring to FIGS. 3, 4, 5 and 6, the security device (2) preferably further comprises a tightening means disposed inside the sleeve (28) for keeping the dead bolt (6) tight as it is in a lock position in the sleeve (28).

The tightening means may comprise a spring-leaf (40) mounted inside the sleeve (28) and facing the opening (38) in the first plate (22) and a screw (42) mounted inside the sleeve (28) accessible from the outside for adjusting the spring-leaf (40).

The security device (2) may also comprise spring means for bringing back the outer arm (36) in an open position as the dead lock (6) is in an unlock position, thereby allowing the door (8) to freely open and close without hitting the outer arm (36).

As illustrated in FIG. 1, the spring means may comprise a spring (43) operatively mounted at one end of the hinge (32).

The security device may also comprise a protective covering or hood (not illustrated) mounted on the security device and adapted to receive the outer arm. Advantageously, this protective covering is used for hiding and protecting the outer arm.

Figure 5:
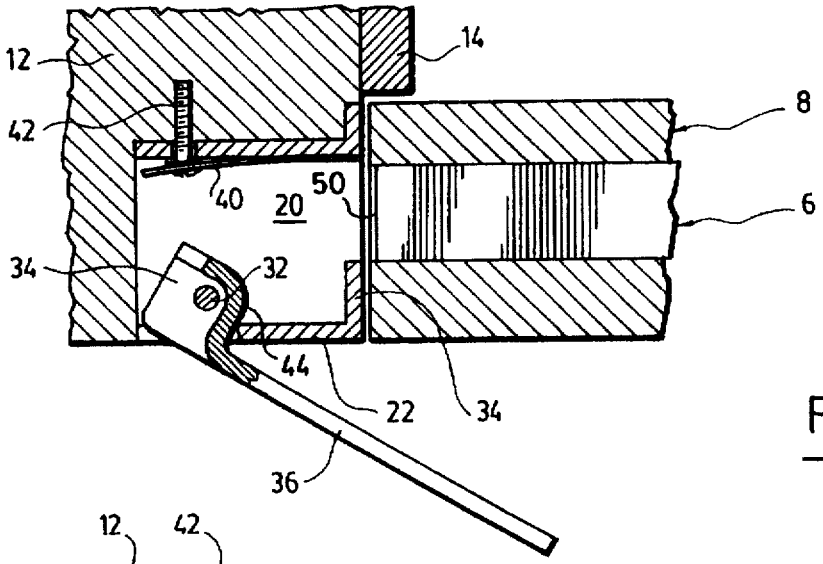
FIG. 5 is the same view as FIG. 3 showing a second preferred version of a lever according to the present invention in which the dead bolt is in an unlock position.
Figure 6:
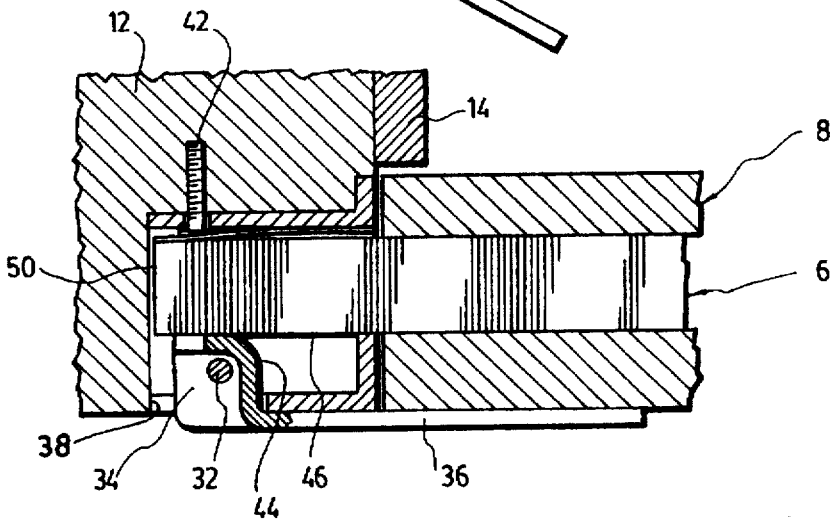
FIG. 6 is the same view as FIG. 5 showing the dead bolt in a lock position.
Figure 7:
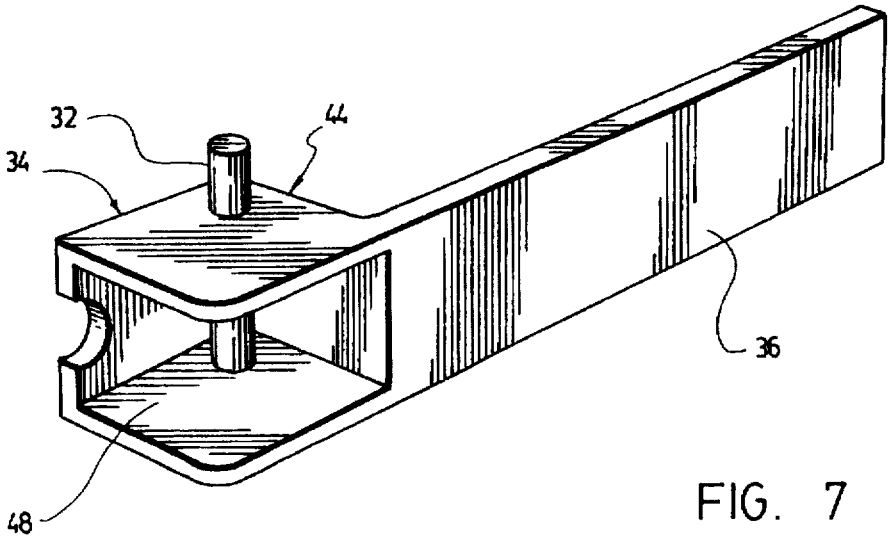
FIG. 7 is a perspective view of the lever shown in FIGS. 5 and 6.

Referring to FIGS. 5 to 7, in a first preferred embodiment of the invention, the inner arm (34) of the lever (30) has a rounded outline (44) on which a lateral surface (46) of the dead bolt (6) abuts when the dead bolt (6) is in a lock position. In this first preferred embodiment, the inner arm (34) of the lever (30) may have a hollow portion (48) defining a passage between the opening (38) in the first plate (22) and the screw (42) of the spring-leaf (40), thereby making the screw (42) accessible from the inside. Preferably, this embodiment may further comprise adjustment means for adjusting the lever to any length of dead bolt. These adjustment means may comprise a spring mounted on an inner face of the inner arm.

Referring to FIGS. 3 and 4, in a second preferred embodiment of the invention, the lever (30) has an L-shaped cross section, the inner arm (34) then corresponding to the short portion of the L and the outer arm (36) corresponding to the longer portion of the L. In this preferred embodiment, it is the free end (50) of the dead bolt (6) in a lock position that abuts on the inner arm (34).

Although preferred embodiments of the invention have been described in detail herein and illustrated in the accompanying drawings, it is to be understood that the invention is not limited to these precise embodiments and that various changes and modifications may be effected therein without departing from the scope or spirit of the invention.

What is claimed is:

1. A security device for a dead bolt lock, the dead bolt lock including a dead bolt and being mounted on a door having a given outline, the door itself being mounted in a doorframe provided with a door stop on which the door abuts when it is closed, an inner surface surrounding the door when the door is closed, and an outer lateral surface disposed opposite the door stop with respect to the inner surface, the dead bolt being movable between an unlock position where it remains inside the outline of the door thereby allowing the door to open, and a lock position where the dead bolt juts out over the outline of the door and engages a cavity provided for that purpose in the inner surface of the doorframe, the security device comprising:

a first rigid vertical plate for attachment to said doorframe and shaped to extend flat on the outer lateral surface of the doorframe opposite the door stop just in front of the cavity in the doorframe;

a security lever mounted on said first plate and pivotable about a vertical axis adjacent to the first plate, the security lever including an inner arm on one side of the first plate for extending in the cavity of the doorframe for engagement with the dead bolt when the dead bolt is moved to the lock position thereby causing the lever to pivot around said vertical axis, the security lever further including an elongated outer arm integral with the inner arm and extending on another side of the first plate opposite said one side, the outer arm being shaped and sized for abutment on an outer surface of the door when the dead bolt has been moved to the lock position and has caused the lever to pivot around said vertical axis; and first fastening means for securing the security device via the first plate to the doorframe.

2. A security device as claimed in claimed 1, wherein the inner arm of the lever is sized for extending only partially within the cavity of the doorframe and has a shape adapted for engagement by a lateral surface of the dead bolt when the dead bolt is in a lock position.

3. A security device as claimed in claim 2, further comprising a second rigid vertical plate integral to the first plate and shaped to extend flat on the inner surface of the doorframe, the second plate being provided with an opening for facing the cavity in the doorframe and for receiving the dead bolt; and second fastening means for securing the security device to the doorframe via the second plate.

4. A security device as claimed in claim 3, further comprising a rigid sleeve integral to the first and second plates, the sleeve being coaxial with the opening provided in the second plate and being adapted for extending in the cavity of the doorframe for receiving the dead bolt as it is in a lock position.

5. A security device as claimed in claim 4, wherein the first plate is provided with an opening on the inside of the sleeve, said vertical axis of the lever extending across the opening in the first plate.

6. A security device as claimed in claim 5, further comprising:

a tightening means disposed inside the sleeve for keeping the dead bolt tight as it is in a lock position in the sleeve.

7. A security device as claimed in claim 1, wherein the lever has an L-shaped cross section, the inner arm corresponding to the short portion of the L and the outer arm corresponding to the longer portion of the L, whereby the inner arm is adapted for engagement by a free end of the dead bolt when it is in a lock position.

8. A security device for a dead bolt lock, the dead bolt lock including a dead bolt and being mounted on a door having a given outline, the door itself being mounted in a doorframe provided with a door stop on which the door abuts when it is closed, an inner surface surrounding the door when the door is close, and an outer lateral surface disposed opposite the door stop with respect to the inner surface, the dead bolt being movable between an unlock position where it remains inside the outline of the door thereby allowing the door to open, and a lock position where the dead bolt juts out over the outline of the door and engages a cavity provided for that purpose in the inner surface of the doorframe, the security device comprising:

a first rigid vertical plate for attachment to said doorframe and shaped to extend flat on the outer lateral surface of the doorframe opposite the door stop just in front of the cavity in the doorframe;

a second rigid vertical plate integral to the first plate and shaped to extend flat on the inner surface of the doorframe, the second plate being provided with an opening for facing the cavity in the doorframe and for receiving the dead bolt;

a rigid sleeve integral to the first and second plates, the sleeve being coaxial with the opening provided in the second plate and being adapted for extending in the cavity of the doorframe for receiving the dead bolt as it is in a lock position:

a tightening means disposed inside the sleeve for keeping the dead bolt tight as it is in a lock position in the sleeve;

a security lever mounted on said first plate and pivotable about a vertical axis adjacent to the first plate, the security lever including an inner arm on one side of the first plate for extending in the cavity of the doorframe for engagement with the dead bolt when the dead bolt is moved to the lock position thereby causing the lever to pivot around said vertical axis, the security lever further including an elongated outer arm integral with the inner arm and extending on another side of the first plate opposite said one side, the outer arm being shaped and sized for abutment on an outer surface of the door when the dead bolt has been moved to the lock position and has caused the lever to pivot around said vertical axis;

first fastening means for securing the security device via the first plate to the doorframe;

second fastening means for securing the security device to the doorframe via the second plate;

wherein the first plate is provided with an opening on the inside of the sleeve, said vertical axis of the lever extending across the opening in the first plate; and wherein the tightening means comprise a spring-leaf mounted inside the sleeve and facing the opening in the first plate.

9. A security device as claimed in claim 8, further comprising a screw mounted inside the sleeve and accessible from the outside for adjusting the spring-leaf.

10. A security device as claimed in claim 9, wherein the inner arm of the lever has a rounded outline on which said lateral surface of the dead bolt abuts when the dead bolt is in a lock position.

11. A security device as claimed in claim 10, wherein the inner arm of the lever has a hollow portion defining a passage between the opening in the first plate and the screw of the spring-leaf, thereby making the screw accessible from the inside.

12. A security device as claimed in claim 11, wherein the outer arm is flat.

13. A security device as claimed in claim 12, wherein the first plate, the second plate, the sleeve and the lever are made of metal and wherein the sleeve is welded to the first and second plates.

* * * * *